United States Patent [19]

Randisi

[11] Patent Number: 5,002,675

[45] Date of Patent: Mar. 26, 1991

[54] CABLE PULLING COMPOUNDS

[76] Inventor: Sal A. Randisi, 24 DaVinci Dr., Bohemia, N.Y. 11716

[21] Appl. No.: 379,061

[22] Filed: Jul. 13, 1989

[51] Int. Cl.[5] ..... C10M 173/02; C10M 145/40

[52] U.S. Cl. ..... 252/49.3; 252/41; 252/52 R; 252/56 R; 252/57

[58] Field of Search ..... 252/57, 49.3, 41, 56 R

[56] References Cited

U.S. PATENT DOCUMENTS

| | | | |
|---|---|---|---|
| 3,654,153 | 4/1972 | Nikitin | 252/49.3 |
| 3,860,521 | 1/1975 | Aepli et al. | 252/49.3 |
| 4,045,362 | 8/1977 | Kuan et al. | 252/49.3 |
| 4,111,820 | 9/1978 | Conti | 252/49.3 |
| 4,127,654 | 11/1978 | Inoue et al. | 426/216 |
| 4,378,299 | 3/1983 | Alexander | 252/49.3 |

*Primary Examiner*—Prince E. Willis
*Assistant Examiner*—E McAvoy
*Attorney, Agent, or Firm*—Stephen E. Feldman

[57] ABSTRACT

Aqueous cable pulling made from propylene glycol, mixture of sodium carboxymethyl cellulose and hydroethyl cellulose, mixture of methyl- and propylparabens and water and method of preparing such compounds are claimed. The composition includes from about 10% to about 30% by weight of propylene glycol, from about 0.1% to about 1% by weight of sodium carboxymethyl cellulose, from about 0.01% to about 1% by weight of hydroxyethyl cellulose, from about 0.01% to about 1% by weight of methyl paraben and from about 65% to about 90% by weight of water.

11 Claims, No Drawings

CABLE PULLING COMPOUNDS

FIELD OF THE INVENTION

The invention relates to the cable pulling compounds and more specifically, to compounds that can be used to facilitate drawing or pulling wire or cable through a conduit.

BACKGROUND OF THE INVENTION

The pulling compounds are lubricants that are used for lubricating the interface between two relatively moving surfaces where a number of requirements have to be met. The compounds must be essentially chemically and physically inert with respect to the surfaces. The compounds must reduce the force required to move one surface over the other. In addition, the compounds must be in a form that permits the easy application to one or both surfaces.

In the prior art, the pulling compounds were prepared by thickening natural fats and oils and clay or chalk in order to provide sufficient lubrication during pulling an object through a conduit. With the start of the petroleum industry lubricant oils and greases were prepared from heavy petroleum oil fractions. In many applications petroleum lubricants are undesirable. Petroleum lubricants can interact with many organic and inorganic substances such as plastics and rubbers, can be difficult to clean up after application and can be unpleasant to workmen.

In view of the serious drawbacks that petroleum lubricant can have in certain applications, water based lubricants were developed. The use of many different water based lubricants is well known. More specifically, aqueous based compositions of high molecular weight polyalkylene oxide polymers have been prepared for a variety of applications including lubrication. Many other compounds have been used in preparing aqueous lubricants such as various fatty acid soaps, acrylate polymers, waxes, alkylene glycols, guar gum, Irish moss, carboxymethyl cellulose, phenolic and amine-formaldehyde resins, hydrocarbon sulfonic acids, gelatin, polyurethanes, and others.

U.S. Pat. No. 3,227,652 (Ackerman) describes an aqueous lubricant comprising ethylene oxide homopolymer having the average molecular weight about 100,000.

U.S. Pat. No. 3,000,826 (Gililand) describes an aqueous cutting oil composition comprising water as the main constituent, 5 to 40 percent of polyethylene glycol, polypropylene glycol or a mixture thereof, 3 to 18 percent alkali metal nitrite and 2 to 15 percent of a secondary or tertiary alkonol amine.

U.S. Pat. No. 4,378,299 (Alexander) describes a water soluble cable pulling lubricating composition. The composition includes an aqueous solution of from about 1 to 4 percent of a water soluble cellulose derivative such as carboxymethyl cellulose, and from about 0.5 to 2 percent of polyacrylamide. The lubricant may also include a hydroscopic agent such as ethylene glycol to prevent the lubricant from drying out too rapidly in use.

U.S. Pat. No. 4,522,733 (Jonnes) relates to aqueous gel lubricants used during installation of electrical or telephone cable in conduit. The lubricant comprises a major portion of water, a polyelectrolyte acrylate compound, a fatty acid compound and a $C_{1-6}$ alcohol.

The known aqueous based pulling compositions suffer certain disadvantages. The compositions are expensive, can be stiff, nonthixotropic, can be hard to handle and apply to the surface, can fail to reduce the coefficient of friction under a broad load range.

It is therefore an object of this invention to provide an improved pulling compositions which are inexpensive, have low coefficient of friction and easy to handle.

SUMMARY OF THE INVENTION

The present invention relates to a water based pulling composition comprising from about 10 to about 30 percent by weight of hydroxy compound, from about 0.1 to about 4 percent by weight of a mixture of water soluble cellulose derivatives, from about 0.01 percent to about 1 percent by weight of paraben compounds and from about 65 percent to about 89 percent of water.

The present invention also relates to a method of preparing a cable pulling composition which comprises: (a) mixing of a sufficient amount of paraben compounds with hydroxy compound to form a solution of parabens; (b) mixing said solution with water to achieve a single phase solution; (c) adding of a sufficient amount of water soluble cellulose compounds to said single phase solution to produce a homogeneous mixture; (d) drying said mixture until white powder precipitate is formed.

DETAILED DESCRIPTION OF THE INVENTION

The pulling compositions useful for facilitating pulling cables and wires and drawing wire include the combination of hydroxy and paraben compounds with a water soluble cellulose derivatives dissolved in water.

To achieve the full advantage of the present invention the hydroxy compounds (hydroxy substituted aliphatic compounds) in preparing the compositions of the invention include compounds having from 1 to 3 hydroxy groups and from 1 to 6 carbon atoms. The hydroxy compounds can be essentially straight or branched chain compounds. Examples of suitable hydroxy compounds include methanol, ethanol, isopropanol and propylene glycol. Preferred hydroxy compound is propylene glycol.

The water soluble cellulose derivative may be chosen from among the alkyl cellulose including, for example, methyl cellulose, hydroxyethyl cellulose, hydroxypropyl cellulose, carboxythyl cellulose and their salts. However, the preferred water soluble cellulose derivative is a mixture of hydroxyethyl cellulose and sodium carboxymethyl cellulose. Carboxymethyl cellulose is a hydrophilic film former which forms a gell when mixed with water, and possesses good lubricating properties.

The paraben compounds that can be used in the novel pulling compositions of the invention are esters of p-hydroxybenzoic acids. They are white crystals or needles and freely soluble in water, alcohols, acetone, ether. Parabens are well known as preservatives in the food, pharmaceutical and cosmetic industries. The mixture of methylparaben and propylparaben is most preferred.

The most preferrable composition comprises from about 10 to about 30 percent by weight of propyleneglycol, from about 0.1 to about 1 percent by weight of sodium carboxymethyl cellulose, from about 0.01 to about 1 percent by weight of hydroxyethyl cellulose, from about 0.01 to about 1 percent by weight of methylparaben, from about 0.01 to about 1 percent by weight of propylparaben and from about 65 to about 89 percent by weight of water.

The hydroxy compound, paraben compound and water soluble cellulose derivative are combined in an aqueous solution in a unique fashion to provide a pulling composition which has the properties neither of the constituents possesses. The pulling composition prepared according to the present invention has high lubricity as well as good adherence to the lubricated surface. The dried pulling composition is a very fine white powder. Since the composition is a water soluble mixture, it may be applied in a liquid form directly to the lubricating surface using conventional liquid application technique such as washing, brushing or the like.

In accordance with the present invention the aforesaid compositions can be prepared by blending components in any order. The most preferrable method comprises (1) forming a solution of paraben compounds in hydroxy compound; (2) mixing the solution obtained above with water; (3) adding a water-soluble cellulose compound into an aqueous medium with agitating resulting in a smooth, apparently single phase water clear composition; (4) drying the mixture until a white powder precipitate is formed.

The pulling composition of the present invention may also contain a variety of additives, agitants, dyes, colorants, perfumes, or corrosion inhibitors well known in the art.

The following examples disclose the preparation of the novel pulling compositions of the present invention.

EXAMPLE 1

Into a 100 ml glass beaker 1 gram of methylparaben was placed and 1 gram of propylparaben and 200 grams of propylene glycol were slowly added. The mixture was stirred at ambient temperature until the paraben compounds were completely solubilized. The solution was poured into a 1 liter beaker containing 791 grams of water. The mixture was agitated until a stable single phase solution was formed. Then 5 grams of sodium carboxymethyl (CMC 7H3SF) cellulose and 2 grams of hydroxyethyl cellulose (Notrosol 250 HHR) were mixed with water solution in the beaker. Then the mixture is dryed until white powder precipitate if formed.

The following compositions were made using the procedure described in Example 1.

EXAMPLE 2

| | |
|---|---|
| Methylparaben | 0.01% |
| Propylparaben | 0.01% |
| Propylene glycol | 10.00% |
| Sodium carboxymethyl cellulose | 0.10% |
| Hydroxyethyl cellulose | 0.10% |
| Water | 89.78% |
| | 100.00% |

EXAMPLE 3

| | |
|---|---|
| Methylparaben | 1.00% |
| Propylparaben | 1.00% |
| Propylene glycol | 30.00% |
| Sodium carboxymethyl cellulose | 1.00% |
| Hydroxyethyl cellulose | 1.00% |
| Water | 66.00% |
| | 100.00% |

Although the invention has been disclosed in connection with certain specific embodiments, it will be readily apparent to those skilled in the art that various changes in the composition and method can be made without departing from the spirit and scope of the invention.

What is claimed is:

1. A cable pulling composition consisting essentially of from about 10 to about 30 percent by weight of hydroxy compound, from about 0.1 to about 4 percent by weight of a mixture of a water soluble cellulose derivatives, from about 0.01 to about 1 percent by weight of a mixture of paraben compounds and from about 65 to about 90 percent by weight of water.

2. The cable pulling composition of claim 1 wherein said hydroxy compound is propylene glycol.

3. The cable pulling composition in claim 1 wherein the water soluble cellulose derivative is a sodium carboxymethyl cellulose.

4. The cable pulling composition of claim 1 wherein said water soluble cellulose derivative is hydroxyethyl cellulose.

5. The cable pulling composition in claim 1 wherein said paraben compound is methylparaben.

6. The cable pulling composition in claim 1 wherein said paraben compound is propylparaben.

7. A cable pulling composition comprising from about 10 to about 30 percent by weight of propyleneglycol, from about 0.1 to about 1 percent by weight of sodium carboxymethyl cellulose, from about 0.1 to about 1 percent by weight of hydroxyethyl celluose, from about 0.01 to about 1 percent by weight of methylparaben, from about 0.01 to about 1 percent by weight of propylparaben and from about 65 to about 90 percent by weight of water.

8. A cable pulling composition comprising about 20 percent by weight of propyleneglycol, about 0.5 percent by weight of sodium carboxymethyl cellulose, about 0.2 percent by weight of hydroxyethyl cellulose, about 0.1 percent by weight of methylparaben, about 0.1 percent by weight of propylparaben and about 79.1 percent by weight of water.

9. A method of preparing a cable pulling composition which comprises:

(a) mixing of a sufficient amount of paraben compounds with hydroxy compound to form a solution of parabens;

(b) mixing said solution with water to achieve a single phase solution;

(c) adding of a sufficient amount of water soluble cellulose compounds to said single phase solution to produce a homogeneous mixture;

(d) drying said mixture until white powder precipitate is formed.

10. A method of preparing a cable pulling composition which comprises:

(a) mixing of about 0.01 to about 1 percent by weight of methylparaben, from about 0.01 percent to about 1 percent by weight of propylparaben with from about 10 to about 30 percent by weight of propylene glycol to form a solution of parabens;

(b) mixing said solution with water to achieve a single phase solution;

(c) adding of a sufficient amount of from about 0.1 to about 1 percent by weight of sodium carboxymethyl cellulose, from about 0.1 to about 1 percent by weight of hydroxyethyl cellulose to said single phase solution to produce a homogeneous mixture;

(d) drying said mixture until white powder precipitate is formed.

11. A method of preparing a cable pulling composition which comprises:

(a) mixing of about 0.1 percent by weight of methylparaben and about 0.1 percent to about 1 percent by weight of propylparaben with about 20 percent by weight of propylene glycol to form a solution of parabens;

(b) mixing said solution with about 79.1 percent by weight of water to achieve a single phase solution;

(c) adding of a sufficient amount of about 0.5 percent by weight of sodium carboxymethyl cellulose, about 0.2 percent by weight of hydroxyethyl cellulose to said single phase solution to produce a homogeneous mixture;

(d) drying said mixture until white powder precipitate is formed.

* * * * *